US009302840B2

(12) United States Patent
Boukobza

(10) Patent No.: US 9,302,840 B2
(45) Date of Patent: Apr. 5, 2016

(54) CONTAINER HAVING DEFORMABLE FLANKS

(75) Inventor: Michel Boukobza, Octeville sur Mer (FR)

(73) Assignee: SIDEL PARTICIPATIONS, Octeville sur Mer (FR)

( * ) Notice: Subject to any disclaimer, the term of this patent is extended or adjusted under 35 U.S.C. 154(b) by 0 days.

(21) Appl. No.: 13/516,373

(22) PCT Filed: Dec. 16, 2010

(86) PCT No.: PCT/FR2010/000844

§ 371 (c)(1),
(2), (4) Date: Sep. 26, 2012

(87) PCT Pub. No.: WO2011/080418

PCT Pub. Date: Jul. 7, 2011

(65) Prior Publication Data

US 2013/0008913 A1 Jan. 10, 2013

(30) Foreign Application Priority Data

Dec. 17, 2009 (FR) ..... 09 06135

(51) Int. Cl.

| | |
|---|---|
| ***B65D 6/00*** | (2006.01) |
| ***B65D 8/04*** | (2006.01) |
| ***B65D 8/18*** | (2006.01) |
| ***B65D 90/02*** | (2006.01) |
| ***B65D 79/00*** | (2006.01) |
| ***B65D 1/02*** | (2006.01) |

(52) U.S. Cl.

CPC ..... *B65D 79/005* (2013.01); *B65D 1/0223* (2013.01); *B65D 2501/0027* (2013.01); *B65D 2501/0036* (2013.01)

(58) Field of Classification Search

CPC ..... B65D 1/02; B65D 1/40; B65D 23/00; B65D 79/00; B65D 90/02; B65D 1/027; B65D 1/0223

USPC ..... 215/379, 381–384, 396–398, 900; 220/669, 675, 666, 674, 670, 671, 673

See application file for complete search history.

(56) References Cited

U.S. PATENT DOCUMENTS

| | | | | | |
|---|---|---|---|---|---|
| 4,497,855 | A | * | 2/1985 | Agrawal et al. | 428/36.92 |
| 4,805,788 | A | * | 2/1989 | Akiho | 215/381 |
| 4,818,575 | A | * | 4/1989 | Hirata et al. | 428/36.7 |
| 5,092,475 | A | * | 3/1992 | Krishnakumar et al. | 215/381 |
| 5,178,289 | A | * | 1/1993 | Krishnakumar et al. | 215/382 |
| 5,413,244 | A | * | 5/1995 | Ramsey | 220/671 |

(Continued)

FOREIGN PATENT DOCUMENTS

| | | | |
|---|---|---|---|
| FR | 2915737 | A | 11/2008 |
| FR | 2915737 | A1 * | 11/2008 |

(Continued)

*Primary Examiner* — J. Gregory Pickett
*Assistant Examiner* — Jennifer N Zettl
(74) *Attorney, Agent, or Firm* — Sughrue Mion, PLLC

(57) ABSTRACT

A container made of thermoplastic material having a body in which at least one side panel is hollowed out, the container including a central zone having, in a longitudinal plane, a concave profile, and an adjoining zone longitudinally extending the central zone and having, in a longitudinal plane, a convex profile. The central zone and the adjoining zone are stiffened, and the junction between the central zone and the adjoining zone defines a deformable membrane.

14 Claims, 13 Drawing Sheets

(56) References Cited

U.S. PATENT DOCUMENTS

| | | | | | |
|---|---|---|---|---|---|
| 5,704,503 | A * | 1/1998 | Krishnakumar et al. | 215/381 |
| 5,740,934 | A * | 4/1998 | Brady | 215/381 |
| 6,092,688 | A * | 7/2000 | Eberle et al. | 220/669 |
| 6,112,925 | A * | 9/2000 | Nahill et al. | 215/382 |
| 7,137,520 | B1 * | 11/2006 | Melrose | 215/381 |
| 7,178,684 | B1 * | 2/2007 | Budden et al. | 215/381 |
| 7,568,588 | B2 * | 8/2009 | Yourist | 215/381 |
| 7,810,664 | B2 * | 10/2010 | Trude | 215/384 |
| D630,104 | S * | 1/2011 | Boukobza | D9/667 |
| D637,495 | S * | 5/2011 | Gill et al. | D9/538 |
| D648,633 | S * | 11/2011 | Boukobza | D9/538 |
| D651,091 | S * | 12/2011 | Boukobza | D9/538 |
| 8,186,529 | B2 * | 5/2012 | Kinmont et al. | 215/383 |
| 8,328,033 | B2 * | 12/2012 | Mast | 215/381 |
| 2002/0008077 | A1 * | 1/2002 | Lane et al. | 215/381 |
| 2005/0067370 | A1 * | 3/2005 | Tanaka et al. | 215/382 |
| 2005/0269284 | A1 * | 12/2005 | Pedmo et al. | 215/381 |
| 2006/0131258 | A1 * | 6/2006 | Yourist | 215/381 |
| 2007/0039917 | A1 * | 2/2007 | Yourist | 215/379 |
| 2007/0075032 | A1 * | 4/2007 | Kelley et al. | 215/384 |
| 2007/0090083 | A1 * | 4/2007 | Trude | 215/384 |
| 2007/0170144 | A1 * | 7/2007 | Lane et al. | 215/383 |
| 2008/0073315 | A1 * | 3/2008 | Hermel et al. | 215/379 |
| 2008/0257856 | A1 * | 10/2008 | Melrose et al. | 215/381 |
| 2009/0095702 | A1 * | 4/2009 | Ungrady et al. | 215/383 |
| 2010/0012618 | A1 * | 1/2010 | Boukobza | 215/383 |
| 2010/0059532 | A1 * | 3/2010 | Heisner et al. | 220/674 |
| 2010/0116778 | A1 * | 5/2010 | Melrose | 215/381 |
| 2010/0155359 | A1 * | 6/2010 | Simon et al. | 215/382 |
| 2010/0155360 | A1 * | 6/2010 | Mast et al. | 215/383 |
| 2010/0176081 | A1 * | 7/2010 | Kamineni et al. | 215/383 |
| 2010/0206838 | A1 * | 8/2010 | Mast et al. | 215/382 |
| 2010/0232732 | A1 * | 9/2010 | Matthiesen et al. | 383/105 |
| 2010/0301003 | A1 * | 12/2010 | Lewis et al. | 215/384 |
| 2010/0320218 | A1 * | 12/2010 | Tanaka | 220/721 |
| 2011/0049084 | A1 * | 3/2011 | Yourist et al. | 215/382 |
| 2011/0073559 | A1 * | 3/2011 | Schlies et al. | 215/381 |
| 2011/0108515 | A1 * | 5/2011 | Gill et al. | 215/381 |
| 2012/0205342 | A1 * | 8/2012 | Philip et al. | 215/382 |
| 2012/0219738 | A1 * | 8/2012 | Boukobza | 428/35.7 |
| 2012/0228258 | A1 * | 9/2012 | Heisner et al. | 215/384 |
| 2013/0200037 | A1 * | 8/2013 | Yourist et al. | 215/382 |
| 2014/0346135 | A1 * | 11/2014 | Melrose | 215/381 |

FOREIGN PATENT DOCUMENTS

| | | | |
|---|---|---|---|
| JP | 2005-280778 | A | 10/2005 |
| JP | 2005280778 | A * | 10/2005 |

* cited by examiner

CONTAINER HAVING DEFORMABLE FLANKS

CROSS REFERENCE TO RELATED APPLICATIONS

This application is a National Stage of International Application No. PCT/FR2010/000844 filed Dec. 16, 2010, claiming priority based on French Patent Application No. 0906135, filed Dec. 17, 2009, the contents of all of which are incorporated herein by reference in their entirety.

The invention relates to the domain of containers, and more particularly thermoplastic containers, for example made of polyethylene terephthalate (PET), the wall of which is subject to stresses.

A container is generally manufactured by blowing or stretch blowing an injected preform, which is first heated while passing through an oven provided with elements for heating by radiation, then placed hot in a mold provided with a cavity defining the counter-impression of the container.

The cost of the raw material used in manufacturing a container is a large part of the final cost of the container. Thus it would be desirable, within an overall policy of reducing costs, to reduce the amount of material used as much as possible.

However, this reduction has an impact on the mechanical performance, and simply making containers lighter can result in insufficient rigidity, especially during hot filling when the wall of the container is subject to internal stresses due to thermal shock and variations in hydrostatic pressure.

By way of example, the temperature of the liquid during hot filling frequently exceeds 60° C., and commonly reaches 90° C. to 95° C. (i.e. a temperature exceeding the glass transition temperature of the PET, a material that is frequently used).

The container is then cooled, producing a drop in pressure inside the container (essentially due to the retraction in the volume of air it contains), the walls then being subject to new stresses opposite to the preceding ones.

Also, containers intended for hot filling (which are designated as HR, meaning heat resistant) benefit from an appropriate manufacturing and special structural arrangements making them less sensitive to deformations and allowing them to sustainably preserve their general shape.

During manufacturing, a significant contribution to the rigidity of the container is made by heat setting, which consists of temporarily maintaining the container in contact with the heated wall of the mold at the end of the blowing operation, so as to increase the crystallinity of the material.

However, experience has shown that heat setting alone is generally not sufficient to make a container resistant to deformations caused by hot filling, and it is therefore also necessary to provide structural adaptations.

Thus, it is known to provide the container with preferential deformation zones.

These zones can be provided on the bottom of the container, such as in the examples given in the documents WO 2004/028910 and US 2006/0006133. The bottom of the container has a concave or convex shape, so that the bottom lowers down during hot filling, then rises again during cooling.

Theoretically, deformations are therefore localized at the bottom of the container, and the side walls that are spared do not require any particular arrangement of shape. In practice, however, it is rare that the side walls are not deformed, so that it seems necessary to provide them with preferential deformation zones.

The zones are generally in the shape of panels surrounded by rigid frames, the panels of which, in the manner of membranes, are deformed and bulge out during filling, then inversely retract during the cooling of the container. Examples of such panels are given in international applications WO 99/21770 and WO 00/68095.

Containers of this type can be satisfactory from the point of view of performance, but the presence of such panels, surrounded by their rigid frames, has at least two disadvantages: on the one hand, it works against the efforts to reduce the quantity of material; on the other hand, that restricts the creative freedom of designers, since HR containers often have shapes that can be qualified as austere.

A first objective of the invention is to enable containers, particularly of the HR type, to be made even lighter, without sacrificing their mechanical performance however.

A second objective of the invention is to enable the aesthetic improvement of containers provided with special structural arrangements such as privileged deformation zones (or unlike stiffening).

A third objective of the invention is to propose a container that has improved ergonomics, facilitating the gripping of it by a consumer.

To that end, the invention proposes a container made of thermoplastic material comprising a body in which at least one side panel is hollowed out, comprising:

- a central zone which has, in a longitudinal plane, a concave profile, and
- an adjoining zone longitudinally extending the central zone and which has, in a longitudinal plane, a convex profile.

The central zone and the adjoining zone are stiffened, and a deformable membrane is defined at the junction between the central zone and the adjoining zone.

The principal function of this deformable membrane is to concentrate the essential part of the deformations during hot filling. The result is a minimization of deformations on the other parts of the container.

The side panel is preferably designed so that, in the absence of stress, the deformable membrane is substantially flat in a transverse plane.

According to one embodiment, the adjoining zone has a convex profile in a transverse plane.

Moreover, the side panel is preferably delimited by sharp edges.

Furthermore, the adjoining zone can be stiffened by means of longitudinal grooves framing the adjoining zone. Each groove in this case is connected to an intermediate face of the body by a fillet the radius of which is preferably less than that of another fillet connecting the groove to the adjoining zone.

The central zone, which is preferably wider than the adjoining zone, can be stiffened by means of protruding longitudinal ribs that extend over the central zone.

According to one embodiment, the body comprises a plurality of side panels separated by intermediate faces provided with stiffeners.

For example, the side panel comprises a central zone extended longitudinally by two adjoining zones that can be symmetrical, and whose junctions with the central zone respectively define two deformable membranes.

Other objects and advantages of the invention will be seen from the following description, with reference to the appended drawings in which.

Figure 1:
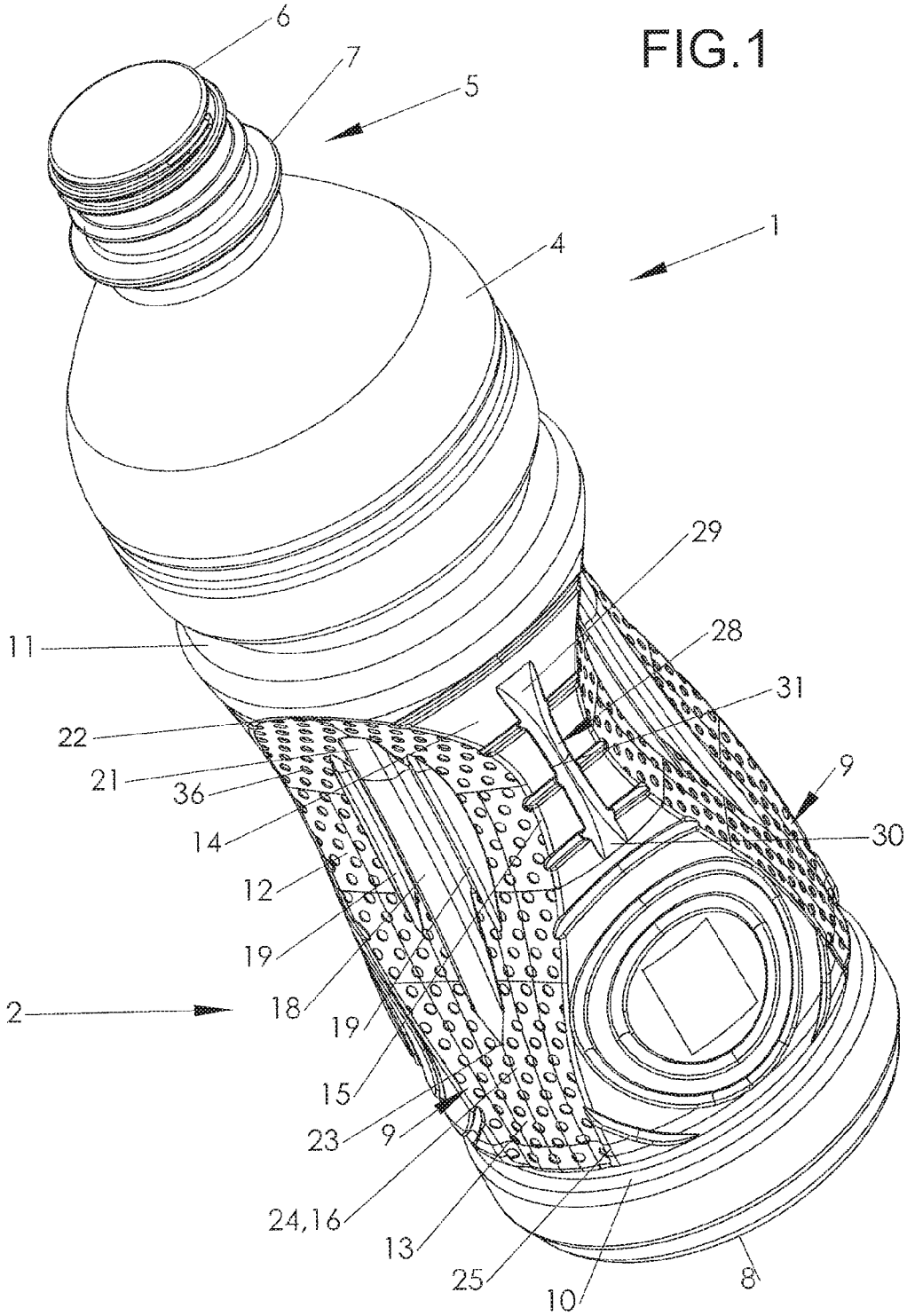
FIG. 1 is a view in perspective of a container comprising three deformable side panels according to a first embodiment.
Figure 2:
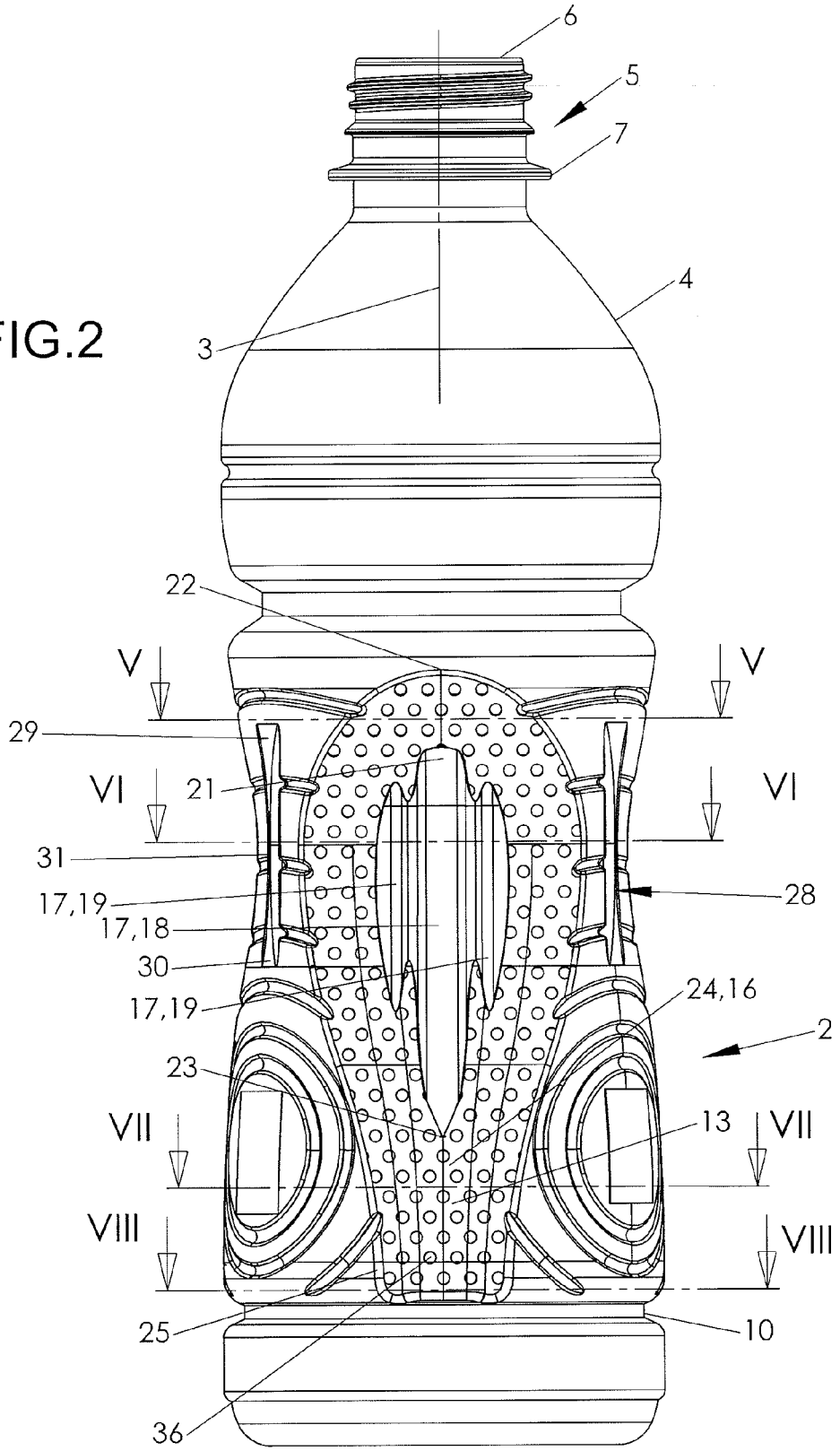
FIG. 2 is a side view of the container from FIG. 1, facing one side panel.
Figure 3:
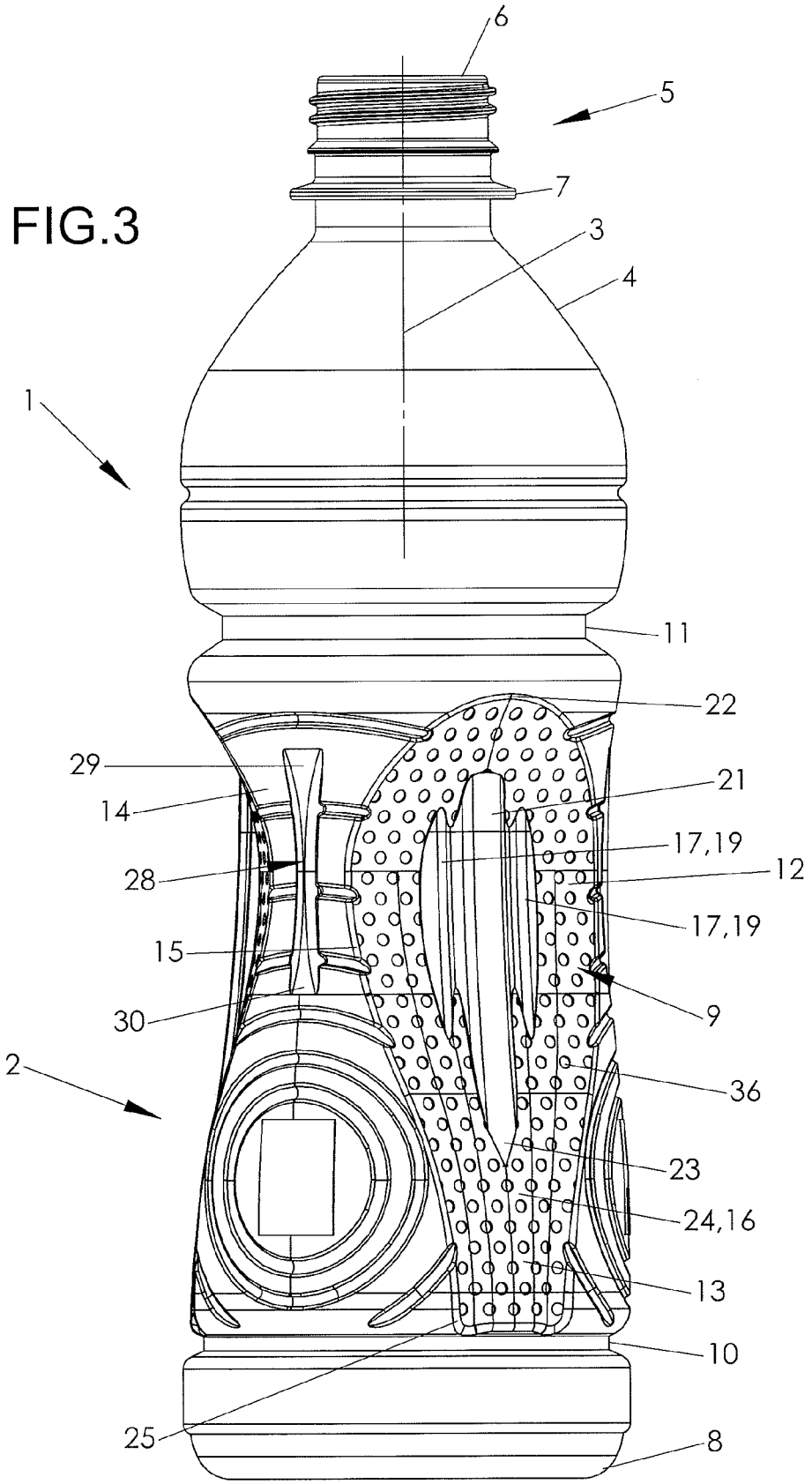
FIG. 3 is a side view of the container from FIG. 1, along the profile of a side panel.

With reference to the figures, a container 1 is illustrated comprising a central body 2 extending along a principal axis 3.

The central body 2 is topped by a shoulder 4 that is generally conical in shape, narrowing to end in a neck 5 provided with a mouth 6 and, in the example, a collar 7 capable of allowing the suspension of the container 1, particularly during filling. The body 2 is closed, opposite the neck 5, by a bottom 8.

For purposes of simplification and clarity, the terms top, bottom, lower and upper are taken here with reference to the natural orientation of containers, it being understood that in the normal resting position, the container 1 is placed on the bottom 8, the mouth 6 facing upward, and the principal axis 3 of the container 1 oriented vertically. A direction is called longitudinal if it extends parallel to the axis 3 of the container 1; a plane is called longitudinal if it contains the axis 3; a plane is called transverse if it is perpendicular to the axis 3.

The container 1 is made of thermoplastic material, for example PET, and can be obtained in a known way by stretch blowing of a previously heated blank.

The body 2 is hollowed out with a series of side panels 9 forming depressions, which extend between a lower groove 10 next to the bottom 8 and an upper groove 11 next to the shoulder 4.

Each side panel 9 comprises a concave central zone 12 and at least one adjoining convex zone 13 that longitudinally adjoins the central zone 12, so that the side panel 9, viewed from the side, has a wavy profile. The concavity and inversely the convexity are here defined with respect to the container 1, concave meaning that the radius of curvature is measured at the outside of the container 1, while convex means that the radius of curvature is measured toward the interior.

Two versions of the container 1 are represented in the figures: a first version in FIGS. 1 to 10; a second version in FIGS. 11 to 17.

In the first version, the container 1 comprises three side panels 9 distributed at 120°, each comprising a concave central zone 12 and a single convex adjoining zone 13, situated next to the bottom 8. The side panels 9 are separated by intermediate faces 14 the transverse cross-section of which is an arc of circle, and is generally complementary in shape to the shapes of the side panels 9.

The width—i.e. the transverse dimension—of the central zone 12 is greater than that of the adjoining zone 13. As can be clearly seen in FIG. 3, the greatest width of the side panel 9 is at the level of the maximum depression of the central zone 12.

The curvature of the central zone 12 varies longitudinally: it is substantially constant at the center of the central zone 12, and decreases progressively as it nears the adjoining zone 13.

Thus, by analogy with the human body, the side panel 9 has a longitudinal profile similar to that of a spinal column, the central zone 12 being similar to the lumbar part of the column and the adjoining zone 13 to the sacrum.

Figure 5:
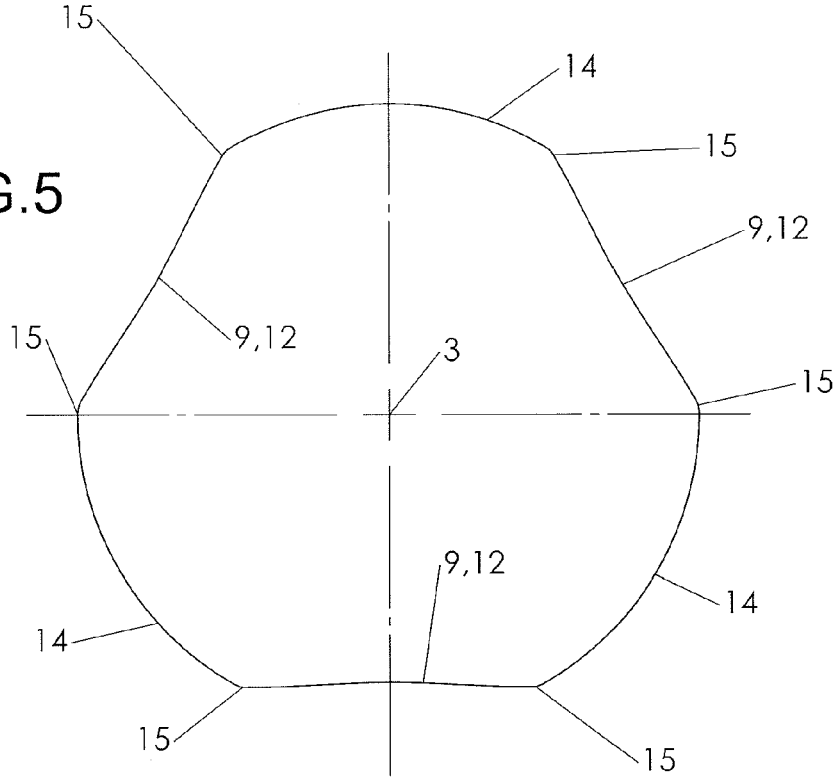
FIG. 5 is a cross-sectional view of the container from FIG. 2 along line V-V.
Figure 6:
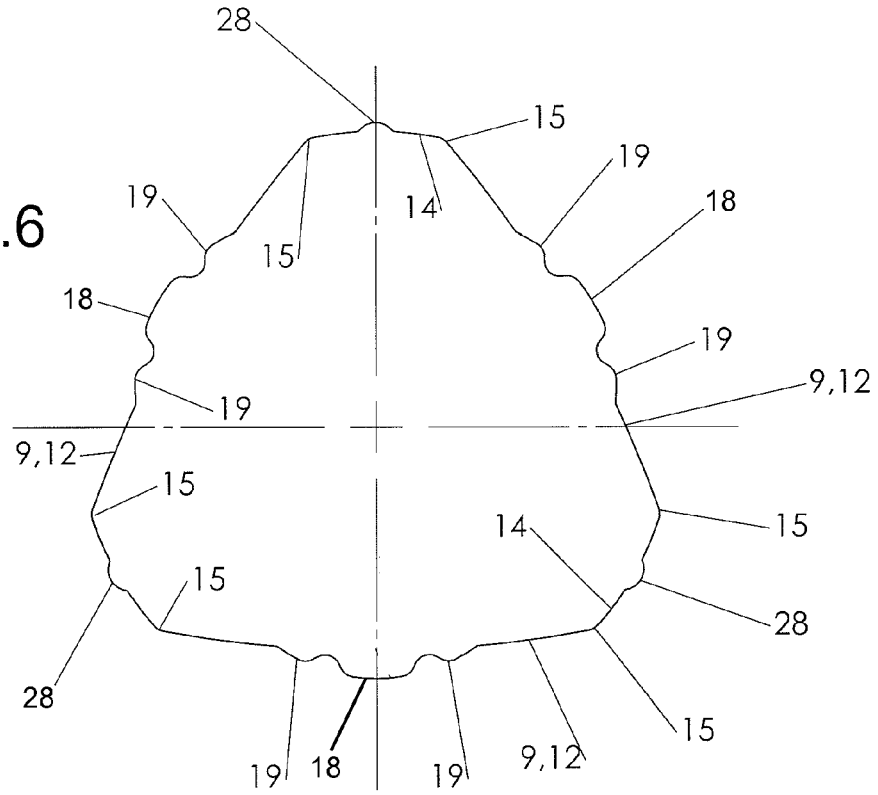
FIG. 6 is a cross-sectional view of the container from FIG. 2 along line VI-VI.
Figure 7:
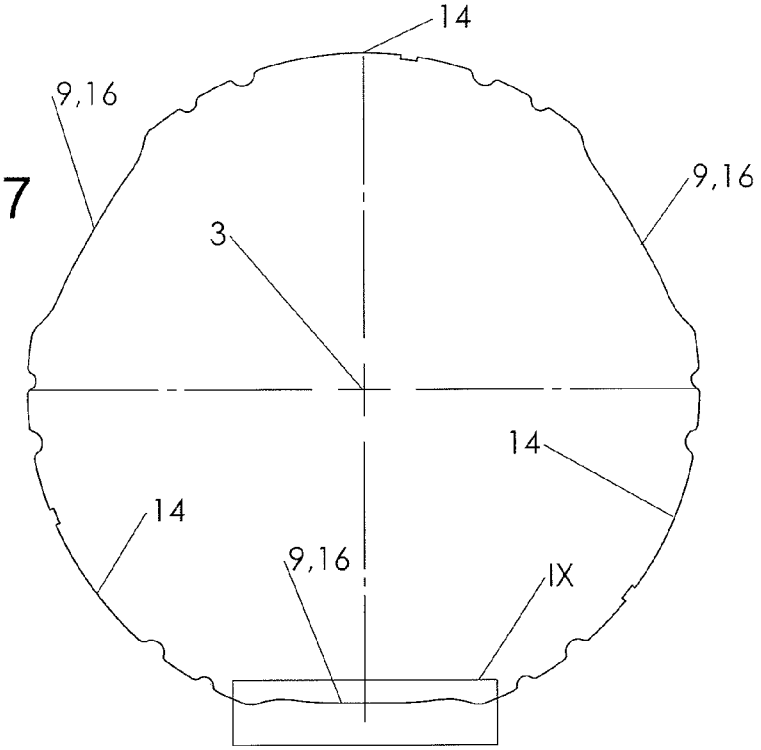
FIG. 7 is a cross-sectional view of the container from FIG. 2 along line VII-VII.
Figure 8:
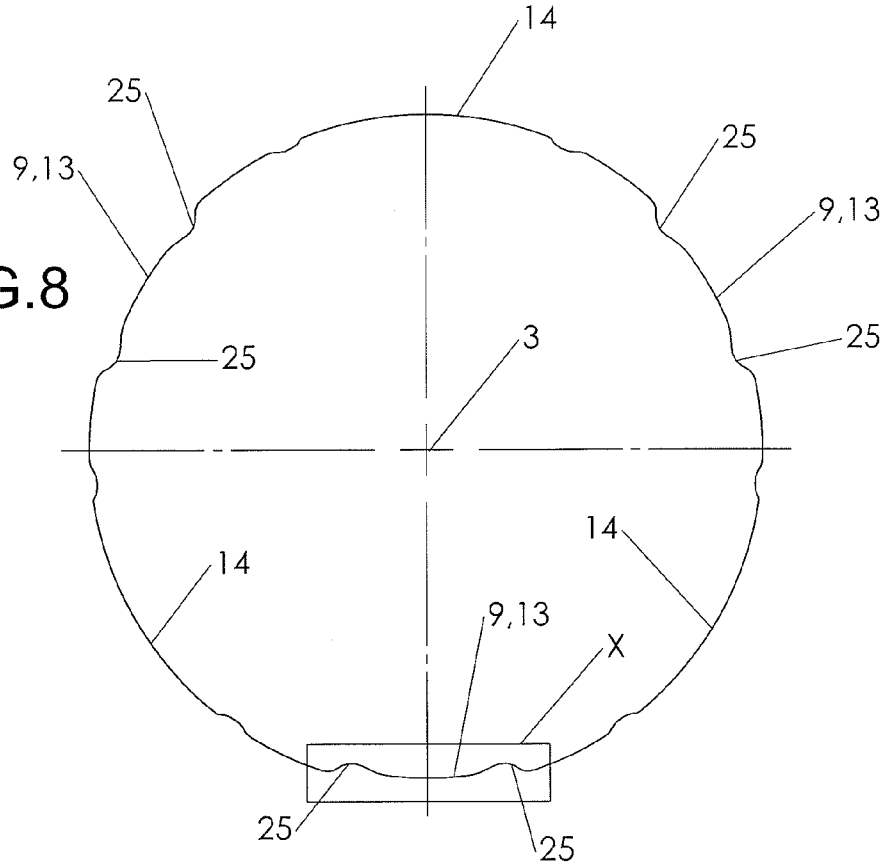
FIG. 8 is a cross-sectional view of the container from FIG. 2 along line VIII-VIII.

As is illustrated in the transverse sections of FIGS. 5 to 8, the curvature of the side panel 9 is also variable transversely. Thus, at the top of the central zone 12, said zone appears slightly concave in a transverse plane (FIG. 5). On the contrary, in a median plane, at the place of greatest width, the central zone 12 is slightly convex (FIG. 6). At the junction between the central zone 12 and the adjoining zone 13, the side panel 9 is substantially flat (FIG. 7). Finally, in the adjoining zone 13, the side panel 9 is convex (FIG. 8).

In other words, the adjoining zone 13 is doubly convex, i.e. in a longitudinal plane as well is in a transverse plane.

Thus, the side panel 9 has the overall shape of a spatula or spoon with a rounded contour, the central zone 12 forming the bowl of the spoon, the adjoining zone 13 forming part of the handle.

As can be seen in the drawings, and particularly in the transverse cross section of FIG. 5, at the central zone 12, the contour of each side panel 9 is delimited by a single edge 15, preferably sharp (i.e. having a small radius), connecting the side panel 9 to the intermediate faces 14—contrary to the conventional structures with panels delimited by beam-type stiffener elements.

At the junction between the central zone 12 and the adjoining zone 13, the side panel 9 locally defines a deformable membrane 16, which is substantially flat in the absence of stress, but which can adopt a curvature depending on the conditions of temperature and hydrostatic pressure in the container.

Figure 9:
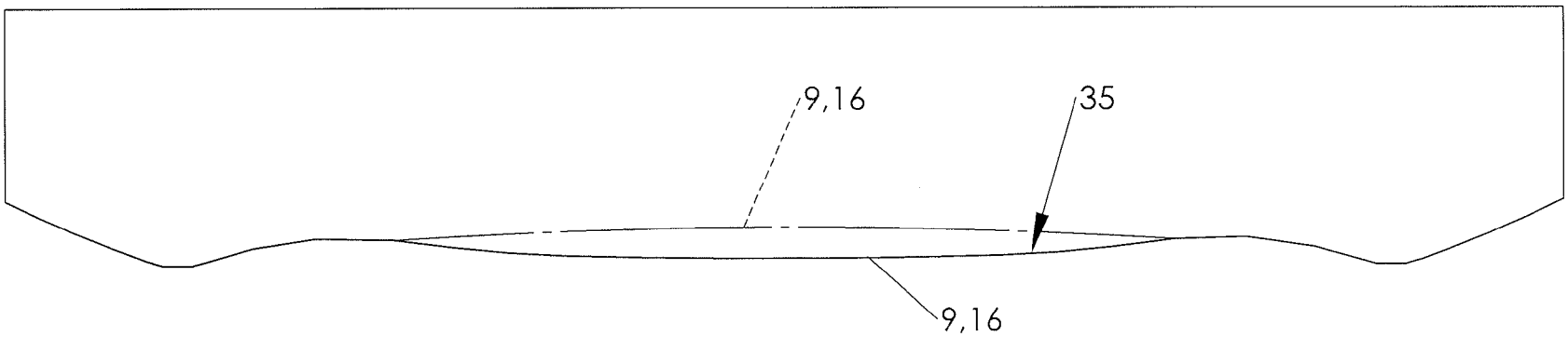
FIG. 9 is a detailed view of FIG. 7 on the profile of a side panel.

Thus, during hot filling, the membrane 16 is deformed by bulging outward from the container 1, adopting a convex configuration in a longitudinal plane as well as in a transverse plane as is illustrated by solid lines in FIG. 9, thus extending the adjoining zone 13 of the side panel 9.

Conversely, when the liquid contained in the container 1—after said container is capped—cools, the retraction of the volume of air it contains and possibly the retraction of the liquid cause a depression which produces a return of the deformable membrane 16, which then adopts a concave configuration both in the longitudinal plane as well is in the transverse plane, as is illustrated by dashed lines in FIG. 9, thus extending the central zone 12 of the side panel 9.

When the container 1 is then opened by the consumer, the equalization of pressures again causes the return of the membrane 16, which again adopts a convex configuration.

Several arrangements make it possible to better localize the deformations on the membrane 16.

On the one hand, each side panel 9 is provided with a stiffener 17 which protrudes radially from the bottom of the central zone 12. The stiffener 17 extends longitudinally on either side of a longitudinal median line of the central zone 12 and comprises three adjacent ribs 18, 19, i.e. a central rib 18 and two lateral ribs 19 that adjoin the central rib 18 on either side thereof. The height and width of the central rib 18 is greater than those of the lateral ribs 19. As can be seen in FIG. 6, the central rib 18 has a slightly concave outer face 20, although its curvature is less than that of the central zone 12 of the side panel 9.

The central rib 18 extends upward to an upper end 21 separated from an upper edge 22 of the central zone, and downward to a lower end 23 adjacent to the junction between the central zone 12 and the adjoining zone 13, i.e. the deformable membrane 16, in such a way that the outer face 20 of the central rib 18 is flush with the outer surface 24 of the deformable membrane 16.

The stiffener 17 has a dual function. First, during hot filling, by its resistance to radial flexion that limits the deformations of the central zone 12 which would tend to bulge out under the effect of the temperature and hydrostatic pressure of the liquid. Then, by its resistance to axial compression, it limits the crushing of the body 2 when the container 1 is stacked.

Figure 10:
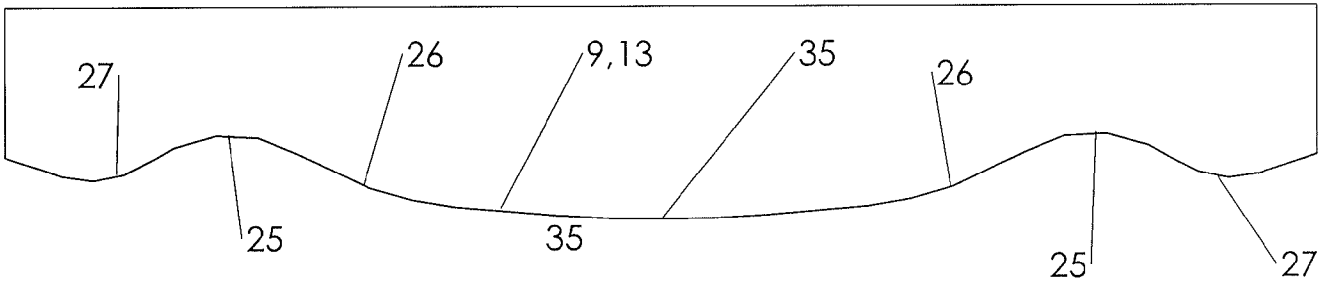
FIG. 10 is a detailed view of FIG. 8 on the profile of a side panel.
Figure 11:
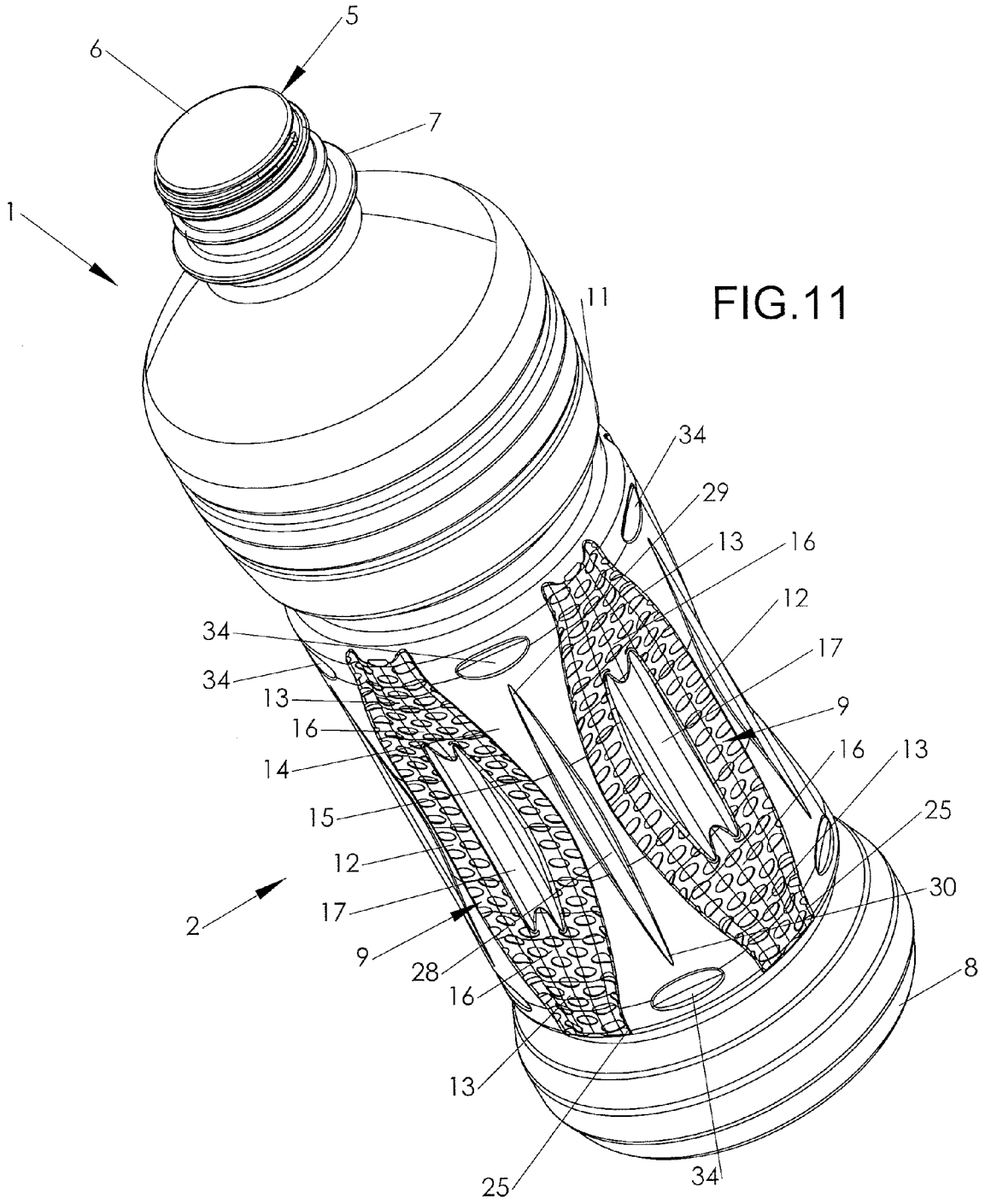
FIG. 11 is a view in perspective of a container comprising three deformable side panels according to a second embodiment.
Figure 12:
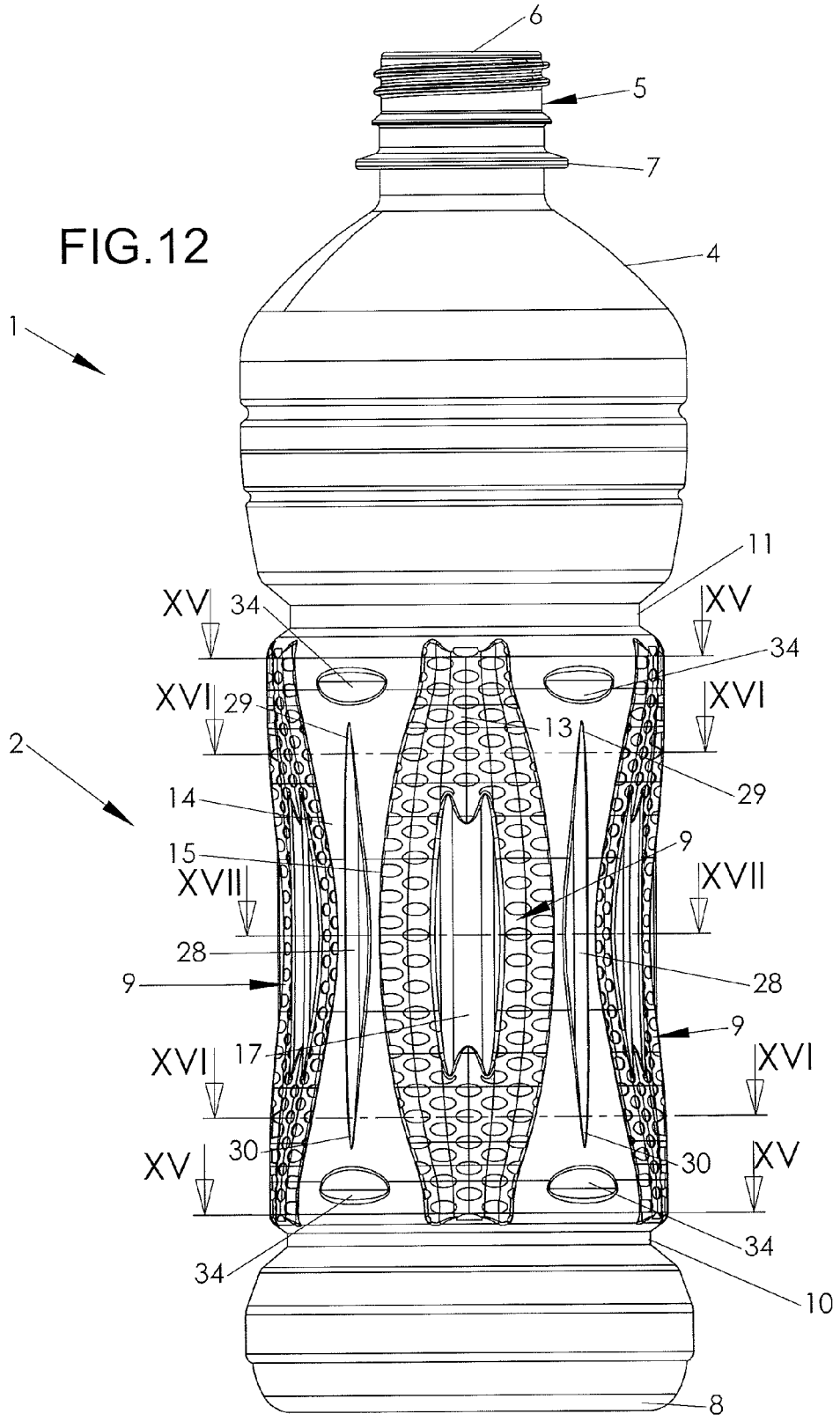
FIG. 12 is a side view of the container from FIG. 11, facing a side panel.
Figure 13:
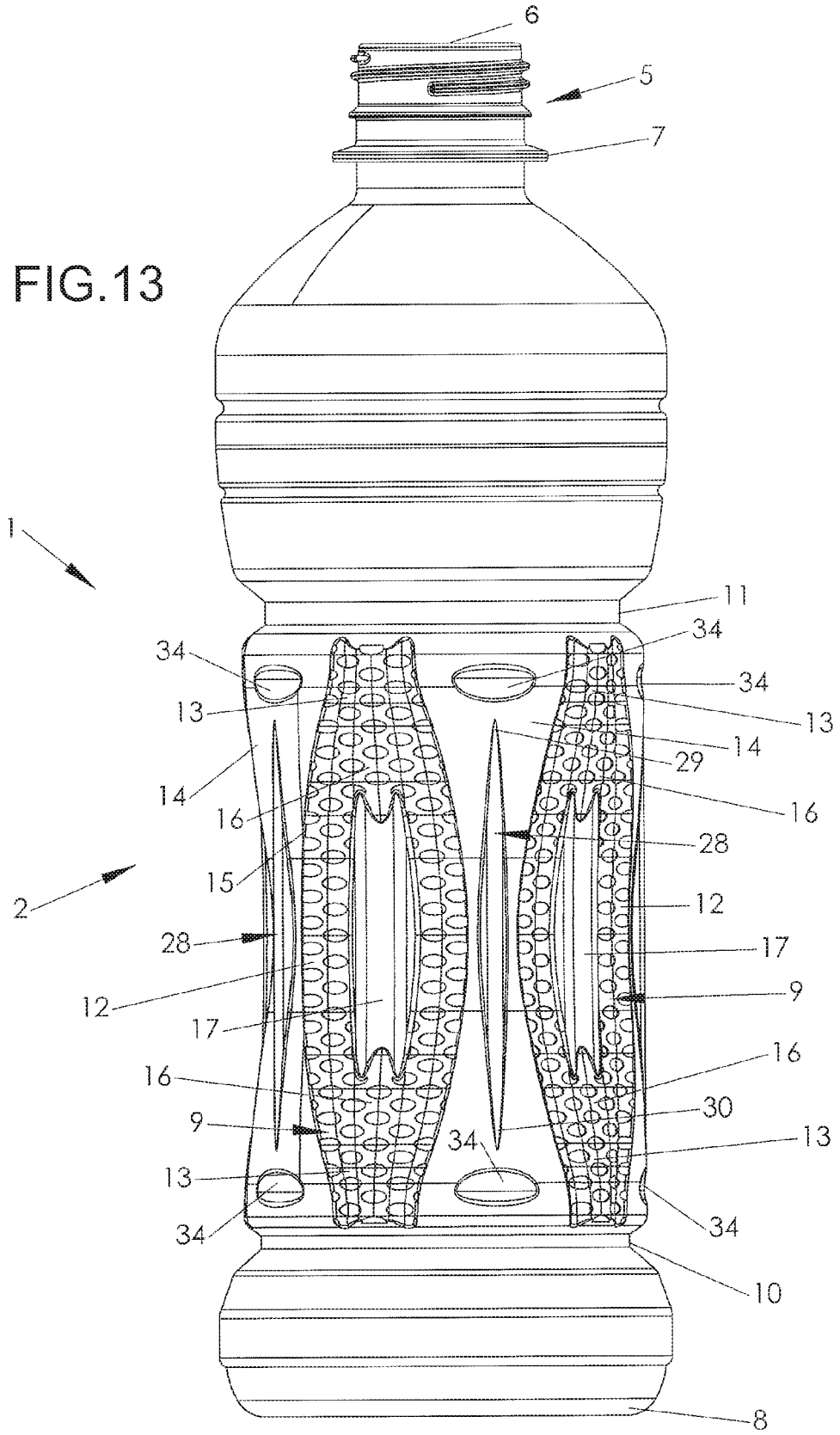
FIG. 13 is a side view of the container from FIG. 11, along the profile of a side panel.
Figure 14:
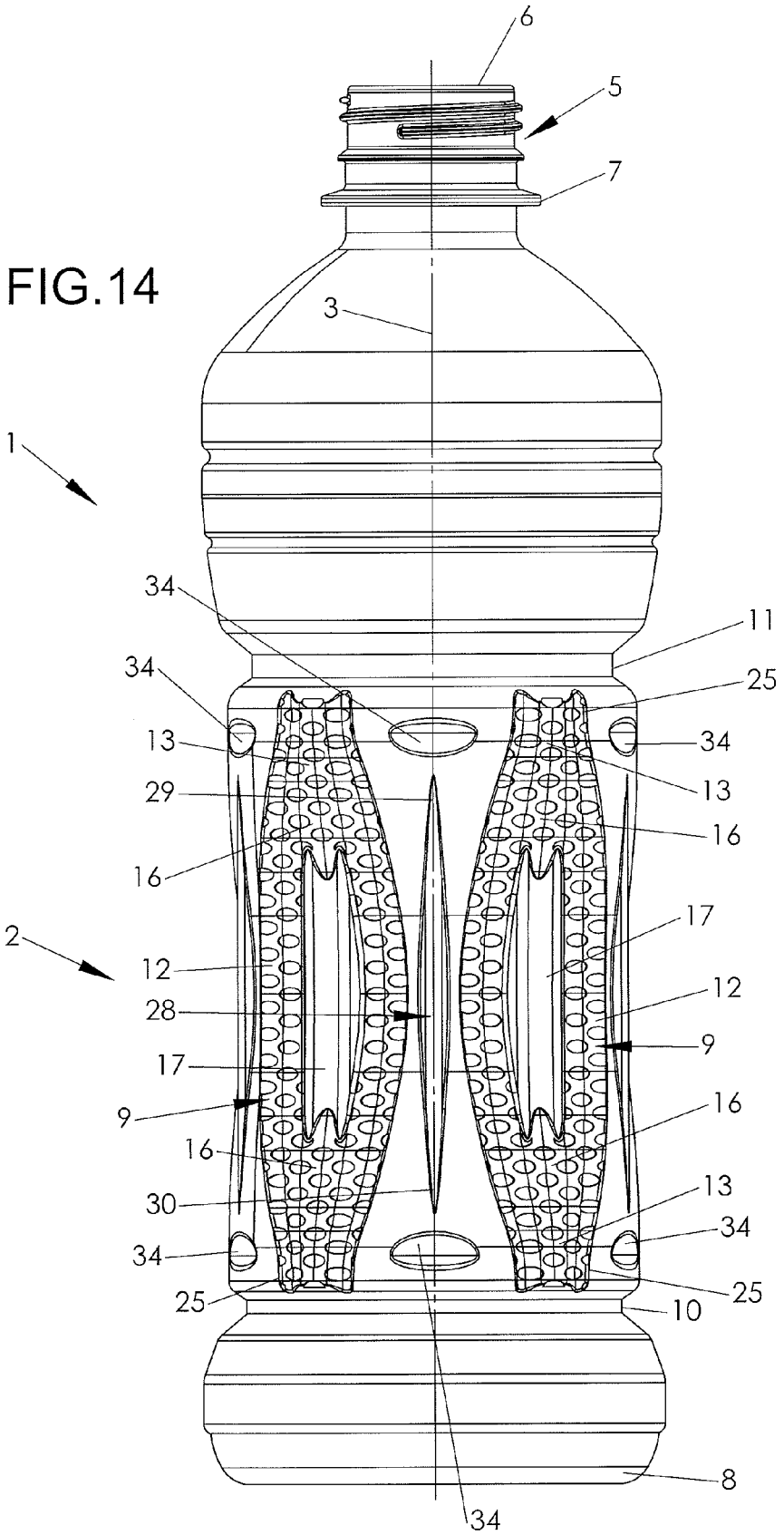
FIG. 14 is a three quarters view of the container from FIG. 11.

Furthermore, each side panel 9 is provided locally, on either side of the adjoining zone 13, with longitudinal grooves 25 having a V-shaped profile with a rounded bottom. The grooves 25 are connected laterally to the adjoining zone 13 by a fillet 26 with a large radius and the adjacent intermediate face 14 by a fillet 27 with a comparatively small radius, the fillet 27 of smaller radius thus forming a sharp edge (FIG. 10).

The function of the grooves 25 during hot filling is to limit the deformations of the adjoining zone 13, the curvature of which would tend to become accentuated under the effect of the temperature and hydrostatic pressure of the liquid.

The result of these arrangements is that, the stiffener 17 limiting the deformations of the central zone 12 and the grooves 25 limiting those of the adjoining zone 13, the deformations of the side panel 9, during hot filling, are locally concentrated on the unstiffened part, i.e. the deformable membrane 16 which forms the junction between the central zone 12 and the adjoining zone 13.

As can be clearly seen in FIGS. 1 to 5, reinforcing means are also provided, in this instance longitudinal ribs 28 projecting from the intermediate faces 14, said ribs 28 having the effect of limiting the deformations of the body 2 during axial compression following a stacking of the container and/or channeling the deformation of the wall of the container by causing, at a plane containing said ribs 28, a deformation of said wall substantially circumscribed within a triangle because of the presence of three ribs (one on each intermediate face 14).

Figure 4:
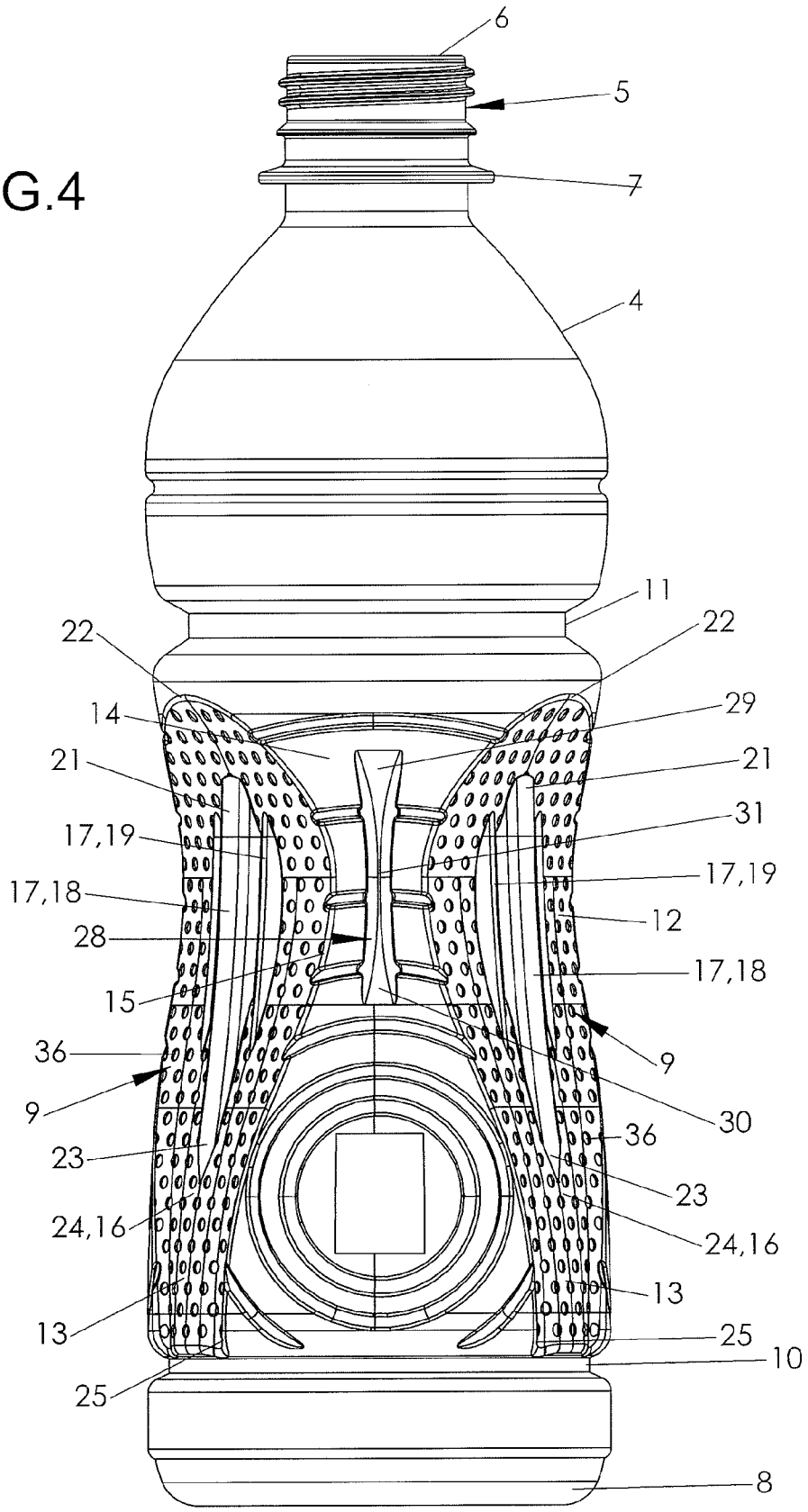
FIG. 4 is a three quarters view of the container from FIG. 1.

FIG. 4 also shows that each rib 28 is arched, and is wider at its ends 29, 30 than its width at its center 31. The result is a better distribution of stresses along the intermediate face 14.

According to the illustrations, the central zone 12 here is directed toward the mouth 6 of the container 1, the adjoining zone 13 being directed toward the bottom 8. However, this arrangement can be reversed without modifying the functions of the side panel 9 and its impact on the performance of the container 1.

In the second version, the container 1 comprises five side panels 9 distributed at 72°, each comprising a central zone 12 and two adjoining zones 13 longitudinally on either side of the central zone 12. As in the first version, the width of the central zone 12 is greater than that of the adjoining zones 13, the place of greatest width corresponding to the maximum depression of the central zone 12.

The side panel 9 is symmetrical with respect to a transverse axis passing through the maximum depression of the central zone. Advantageously, the axis of symmetry is placed substantially at mid-height of the central body 2.

Arranged between two successive side panels 9 is an intermediate face 14 the transverse profile of which is in a form that is generally complementary to those of the side panels, in an arc of circle.

The curvature of the central zone 12 varies longitudinally: it is greatest at the place of maximum depression, on the axis of symmetry, and decreases progressively in the vicinity of the adjoining zones 13.

Figure 15:
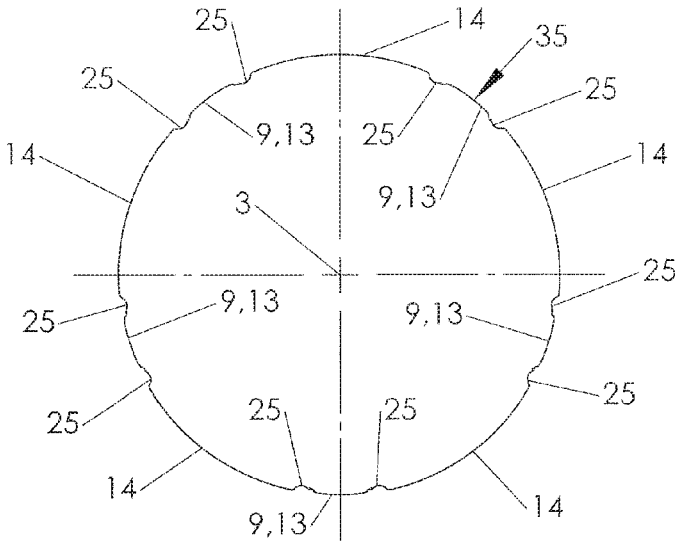
FIG. 15 is a cross-sectional view of the container from FIG. 12 along line XV-XV.
Figure 16:
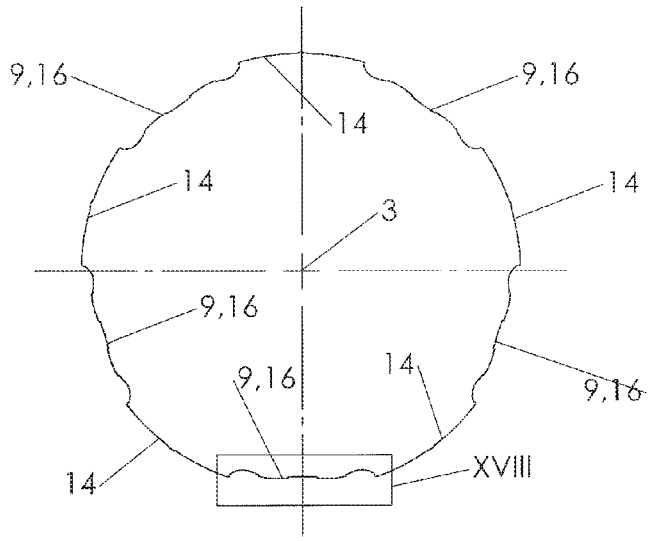
FIG. 16 is a cross-sectional view of the container from FIG. 12 along the line XVI-XVI.
Figure 17:
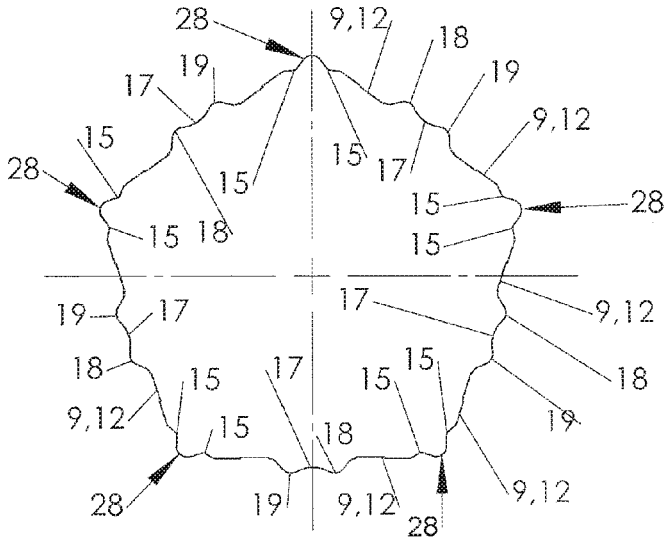
FIG. 17 is a cross-sectional view of the container from FIG. 12 along line XVII-XVII.
Figure 18:
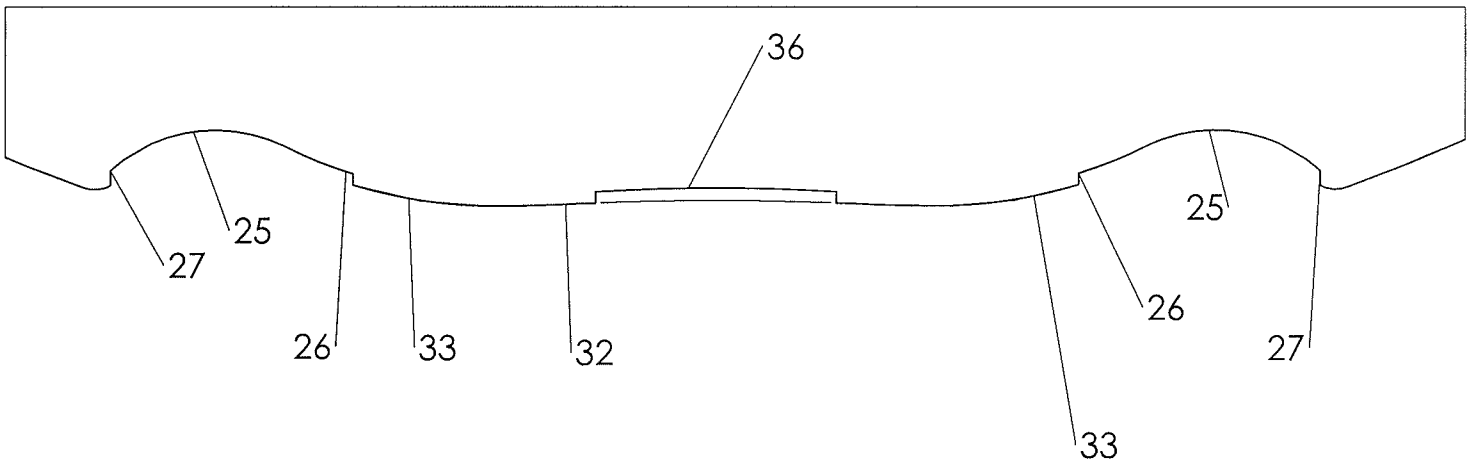
FIG. 18 is a detailed view of FIG. 16 on the profile of a side panel.

As illustrated in the cross-sectional views of FIGS. 15 to 17, the curvature of the side panels 9 also varies transversely. Indeed, the curvature on the adjoining zones 13 is convex (FIG. 15), said convexity being accentuated as the distance from the central zone 12 increases. As the central zone 12 is approached, the curvature decreases (FIG. 16) up to the middle of the side panel 9 where it is substantially zero: the side panel 9 is then substantially flat (FIG. 17). More specifically, in proximity to the central zone 12, the curvature varies and reverses substantially in the middle of the side panel 9: the transverse profile then has a slight waviness (FIG. 18), a concave wave 32 being framed on either side by two convex waves 33.

In the same way as in the first version, each adjoining zone 13 is doubly convex, in the longitudinal plane as well as in a transverse plane.

In the same way as in the first version, the central zone 12 of the side panels 9 is connected to the intermediate faces 14 by a sharp edge 15, i.e. with a radius of curvature substantially smaller than that of the intermediate faces.

Thus, the side panel 9 has two deformable membranes 16 at the junction between the central zone 12 and each adjoining zone 13. In the absence of stresses, these deformable zones 16 are preferably substantially flat, but can have a slight curvature, either concave or convex. Under the effect of stresses, depending on the temperature and hydrostatic pressure conditions, the curvature of these membranes 16 varies to absorb said stresses.

The membranes 16 function substantially in the same way as in the first version: during hot filling, the membranes 16 extend the adjoining zones 13, then when the filled and capped container cools, the membranes 16 extend the central zone 12 of the side panel 9.

When the container 1 is then opened by a consumer, the equalization of pressures again causes the membranes 16 to return and again adopt a convex configuration.

Arrangements similar to the ones already described for the first version are applied in the second version as well, in order to better localize the deformations on the membranes 16.

Thus, a protruding stiffener 17 is also placed on the central zone 12 of the side panels 9. The stiffener 17 extends longitudinally on either side of the median longitudinal line of the side panel 9. According to the preferred embodiment, which is the one illustrated in FIGS. 11 to 18, each stiffener 17 has two identical ribs 18, 19 that are joined to form a W profile. Moreover, the ribs 18 have a slightly concave outer face, the curvature of which is less than that of the central zone 12 of the side panel 9.

The ribs 18, 19 extend longitudinally between the two deformable membranes 16 of the side panels 9, the outer faces terminating in bevels flush with the outer surface of the membranes 16.

Therefore, as with the first version, the stiffener 17 reinforces the resistance of the container 1 to radial flexion and radial compression.

The adjoining zones 13 are framed by longitudinal grooves 25 that have a V-shaped profile with a rounded bottom. The grooves 25 are connected to the intermediate face 14 adjacent to the side panel by a fillet 27 having a radius comparatively smaller than the fillet 26 connecting the grooves 25 to the adjoining zone 13.

The side panels 9, reinforced on the central zone 12 and on the adjoining zones 13, preferably undergo deformations at the junction between the central zone 12 and the adjoining zones 13, i.e. the deformable zones 16.

The intermediate faces 14 also include means for reinforcing them. Thus, longitudinal ribs 28 and notches 34 are placed between the side panels 9. As in the preceding embodiment, said ribs 28 limit the deformations of the body 2 during axial compression following a stacking of the container 1 and/or channeling the deformation of the wall of the container 1. To that end, they cause, on a plane containing said ribs 28, a deformation of said wall substantially circumscribed within a pentagon as a result of the presence of five ribs 28 (one on each intermediate face 14).

The reinforcing ribs 28 protrude from the intermediate faces 14. The upper end 29 and the lower end 30 of each rib 28 terminates in a bevel to blend into the intermediate face 14, so that the height of the rib 28 on the intermediate face 14 is maximal next to the central zone 12 and is minimal next to the adjoining zones 13.

There are two notches 34 on each intermediate face 14 and they are placed in the extension of and at a distance from the upper and lower ends 29, 30 of each reinforcing rib 28. They are generally oval-shaped, extending angularly over the intermediate face 14.

Starting from the second version that has just been described, a side panel 9 can be made comprising three or more deformable membranes 16, simply by alternating central zone 12 and adjoining zone 13 along the longitudinal direction.

According to a variation not shown, the side panel 9 comprises a central zone 12 from which three or more adjoining zones 13 form a star shape, reciprocally forming three or more deformable membranes 16.

Advantageously, the outer surface 35 of the side panels 9 is provided with hollow depressions 36 that limit the slipping of the container 1 when it is gripped by a user.

The embodiments described in the two versions are not limiting, since variations can be made.

Thus, the container 1 can alternatively have side panels comprising a deformable membrane as in the first version, with side panels comprising two or more deformable membranes as in the second version.

Furthermore, while in both versions described here the longitudinal direction is parallel to the principal axis 3 of the body 2, the side panels 9 can be inclined with respect to said axis 3 at an angle up to 90°, so that the side panels 9 extend transversely over the body 2 of the container 1.

On either side of the central body 2, the container 1 can be provided with additional stiffening means, such as beads preventing radial deformations. The bottom 8 can also have a rigidified structure.

The localization of the deformations the deformable membranes 16 makes conventional panels unnecessary, while ensuring the preservation of the general shape of the container 1 all along the production line.

The number of deformable membranes 16 can be adjusted according to need. Thus, by increasing the number of deformable membranes 16, it is possible for the container to undergo even higher stresses, or to reduce the amplitude of the formations undergone by each membrane. This is also true for the number of side panels 9, intermediate faces 14, ribs 28 and notches 34. The ribs 28 cause, at a plane containing said ribs 28, a deformation of the wall of the body 2 substantially circumscribed within a polygon the number of sides of which is determined by the number of ribs 28.

The side panels 9 formed on the body 2 are distinguished from conventional panels particularly by the fact that they are not delimited by additional structures, such as beams, making it possible both to achieve gains in material—and thus weight—as well as to enable aesthetics heretofore unattainable, while improving the ergonomics of the container with a grip that is more secure and more pleasant.

Tests performed on samples of containers 1 with a capacity of 0.5 L have demonstrated mechanical performances equivalent to those of known containers, but with about 15% less weight (less than 20 g).

The invention claimed is:

1. Container made of thermoplastic material comprising a body having a bottom and one hollowed-out side panel, the side panel comprising:

a stiffened central zone provided with a stiffener protruding from the bottom of the central zone and extending longitudinally, the stiffener having a central rib and two lateral ribs, the stiffened central zone having, in a longitudinal plane, a concave profile, a radius of the curvature of the central zone, in a longitudinal plane, being measured at an outside of the container; and a stiffened adjoining zone having, in a longitudinal plane, a convex profile, a radius of curvature of the stiffened adjoining zone, in a longitudinal plane, being measured toward an interior of the container, the stiffened adjoining zone being provided with longitudinal grooves having a V-shaped profile with a rounded bottom, wherein at the junction between the stiffened central zone and the stiffened adjoining zone, the side panel locally defines a deformable membrane, the deformable membrane being convex with pressure in the container and concave while depression exists in the container.

2. Container according to claim 1, wherein, in the absence of stress, the deformable membrane is substantially flat in a transverse plane, perpendicular to a principal axis of the container.

3. Container according to claim 1, wherein the adjoining zone has a convex profile in a transverse plane, perpendicular to a principal axis of the container.

4. Container according to claim 1, wherein the side panel is preferably delimited by sharp edges.

5. Container according to claim 1, wherein the adjoining zone is stiffened by means of longitudinal grooves framing the adjoining zone.

6. Container according to claim 5, wherein each groove is connected to an intermediate face of the body by a fillet the radius of which is preferably less than that of a fillet connecting the groove to the adjoining zone.

7. Container according to claim 1, wherein the stiffened central zone is wider at the stiffened adjoining zone.

8. Container according to claim 1, wherein the body comprises a plurality of side panels separated by intermediate faces provided with reinforcing means, wherein the reinforcing means are longitudinal ribs.

9. Container according to claim 1, wherein the side panel comprises a stiffened central zone extended longitudinally by two stiffened adjoining zones, two deformable membranes being formed at the junction between the stiffened central zone and each stiffened adjoining zone.

10. A container, comprising:

a body having at least a bottom and one hollowed-out side panel, wherein the side panel includes:

a stiffened first zone, provided with a stiffener protruding from the bottom of the first zone and extending longitudinally, the stiffener having a central rib and two lateral ribs, wherein the stiffened first zone is concave in a longitudinal direction, a radius of the curvature of the stiffened first zone, in a longitudinal plane, being measured at an outside of the container;

a stiffened second zone, wherein the stiffened second zone is convex in a longitudinal direction, the radius of the curvature of the stiffened second zone, in a longitudinal plane, being measured toward the interior of the container, the stiffened second zone being provided with longitudinal grooves having a V-shaped profile with a rounded bottom; and a deformable membrane, wherein the deformable membrane forms a junction between the stiffened first zone and the stiffened second zone, the deformable membrane being convex with pressure in the container and concave while depression exists in the container.

11. The container according to claim 10, wherein the deformable membrane is substantially flat in the absence of stress and structured to adopt a curvature when under stress from temperature or hydrostatic pressure in the container.

12. The container according to claim 11, wherein the curvature defines an outward bulge.

13. The container according to claim 10, wherein the deformable membrane is structured to deform when under stress from temperature or hydrostatic pressure in the container, while the first stiffened zone and the second stiffened zone remain stiff relative to the deformable membrane.

14. The container according to claim 10, wherein the deformable membrane is positioned between the first stiffened zone and the second stiffened zone in a vertical direction of the container.

* * * * *